US010232966B2

(12) United States Patent
Jaouen

(10) Patent No.: US 10,232,966 B2
(45) Date of Patent: Mar. 19, 2019

(54) MACHINE FOR CREATING AND FILLING A MULTI-COMPARTMENT POUCH SIMULTANEOUSLY WITH POWDER AND LIQUID

(71) Applicant: Jean-Jacques Jaouen, Gloucester, VA (US)

(72) Inventor: Jean-Jacques Jaouen, Gloucester, VA (US)

( * ) Notice: Subject to any disclaimer, the term of this patent is extended or adjusted under 35 U.S.C. 154(b) by 503 days.

(21) Appl. No.: 14/972,245

(22) Filed: Dec. 17, 2015

(65) Prior Publication Data

US 2016/0176556 A1 Jun. 23, 2016

Related U.S. Application Data

(60) Provisional application No. 62/124,431, filed on Dec. 18, 2014.

(51) Int. Cl.
*B65B 29/10* (2006.01)
*B65B 1/04* (2006.01)
(Continued)

(52) U.S. Cl.
CPC ..... *B65B 29/10* (2013.01); *B65B 1/02* (2013.01); *B65B 1/04* (2013.01); *B65B 1/16* (2013.01); *B65B 1/363* (2013.01); *B65B 3/02* (2013.01); *B65B 3/04* (2013.01); *B65B 3/12* (2013.01); *B65B 7/02* (2013.01); *B65B 9/023* (2013.01); *B65B 35/30* (2013.01); *B65B 39/12* (2013.01); *B65B 51/10* (2013.01); *B65B 51/303* (2013.01);
(Continued)

(58) Field of Classification Search
CPC ... B65B 2051/105; B65B 61/20; B65B 61/06; B65B 51/303; B65B 51/10; B65B 39/12; B65B 35/30; B65B 9/023; B65B 7/02; B65B 3/12; B65B 1/363; B65B 1/16; B65B 1/04; B65B 1/02; B65B 29/10
USPC ..... 53/551
See application file for complete search history.

(56) References Cited

U.S. PATENT DOCUMENTS 3,391,047 A * 7/1968 Kopp ..... B65B 9/023 156/553
3,940,905 A * 3/1976 Perry, III ..... A61F 7/03 53/133.6
(Continued)

*Primary Examiner* — Robert Long
*Assistant Examiner* — Xavier A Madison
(74) *Attorney, Agent, or Firm* — Miller Law Group, PLLC

(57) ABSTRACT

A packaging machine forms, fills and seals a mixing pouch that includes a first compartment containing a liquid ingredient and a second compartment containing a light powdered ingredient with a breakable seal, preferably formed by an adhesive heat seal, between the two compartments to separate the two ingredients. The machine creates a breakable seal that can be ruptured to form a common interior cavity and allow the mixing of the two ingredients to create a mixed product. One end of the mixing pouch can be formed with a dispenser through which the mixed product is discharged for use. The mixing pouch is a flexible plastic member formed from two opposing plastic sheets, sealed through heat dies and supplied with powdered and liquid components before being completed. The operation of the machine is automated and powered through pneumatic cylinders. Alternatively, the compartments could be filled with different liquid components.

17 Claims, 6 Drawing Sheets

(51) Int. Cl.

| | |
|---|---|
| ***B65B 3/02*** | (2006.01) |
| ***B65B 61/06*** | (2006.01) |
| ***B65B 7/02*** | (2006.01) |
| ***B65B 35/30*** | (2006.01) |
| ***B65B 51/10*** | (2006.01) |
| ***B65B 1/02*** | (2006.01) |
| ***B65B 3/04*** | (2006.01) |
| ***B65B 39/12*** | (2006.01) |
| ***B65B 51/30*** | (2006.01) |
| ***B65B 61/20*** | (2006.01) |
| ***B65B 1/16*** | (2006.01) |
| ***B65B 1/36*** | (2006.01) |
| ***B65B 3/12*** | (2006.01) |
| ***B65B 9/02*** | (2006.01) |

(52) U.S. Cl.
CPC ..... *B65B 61/06* (2013.01); *B65B 61/20* (2013.01); *B65B 2051/105* (2013.01)

(56) References Cited

U.S. PATENT DOCUMENTS

| | | | | |
|---|---|---|---|---|
| 5,845,463 | A * | 12/1998 | Henaux | B65B 9/093 53/450 |
| 6,332,305 | B1 * | 12/2001 | Takahashi | B29C 65/18 53/551 |
| 6,342,123 | B1 * | 1/2002 | Rees | B29C 65/76 156/269 |
| 2012/0237643 | A1 * | 9/2012 | Wegner | B65D 75/42 426/115 |

* cited by examiner

Fig. 4
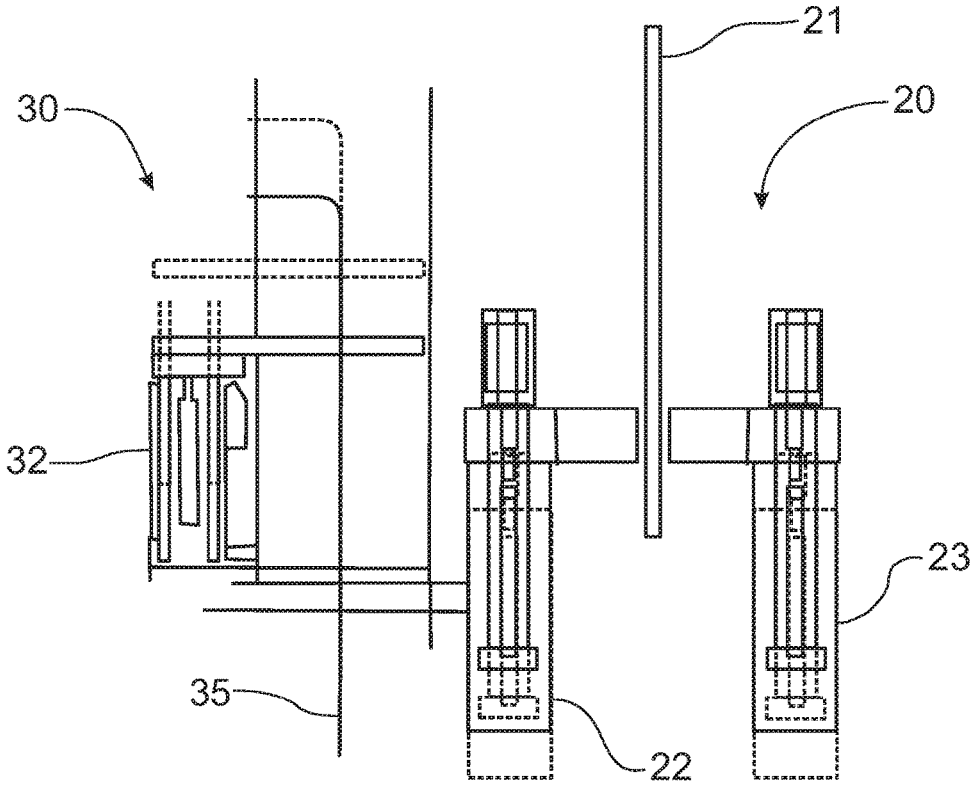
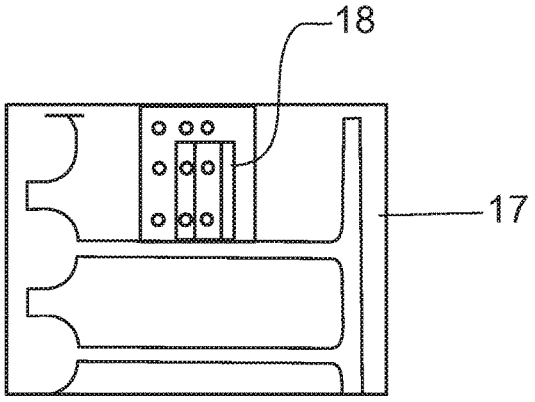
Fig. 5

Fig. 6
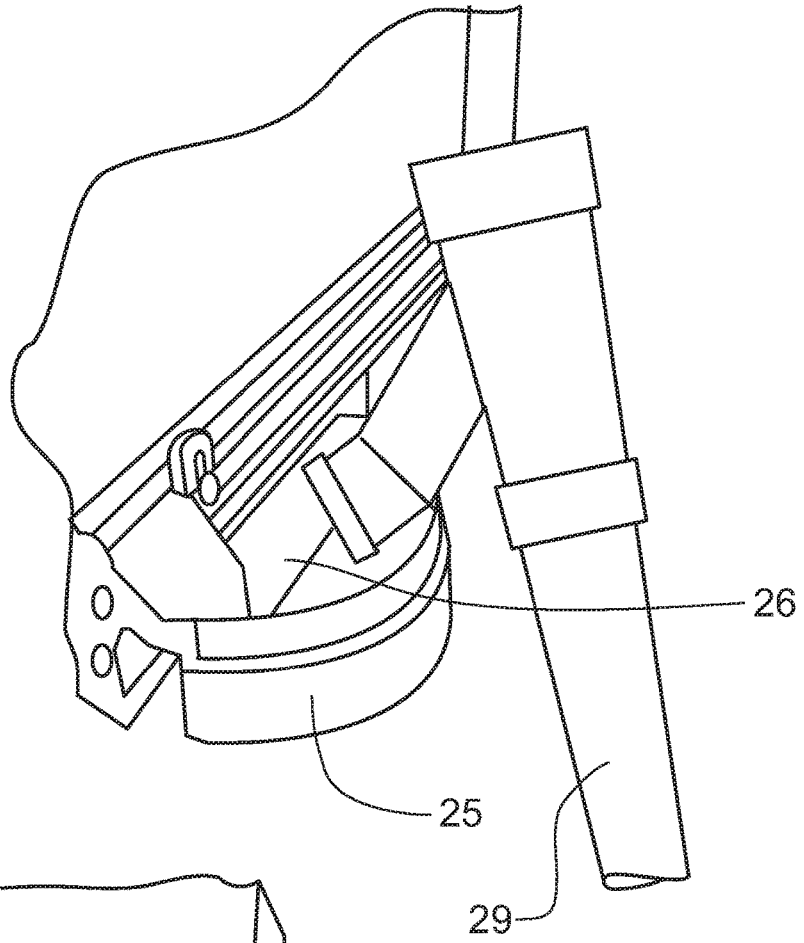
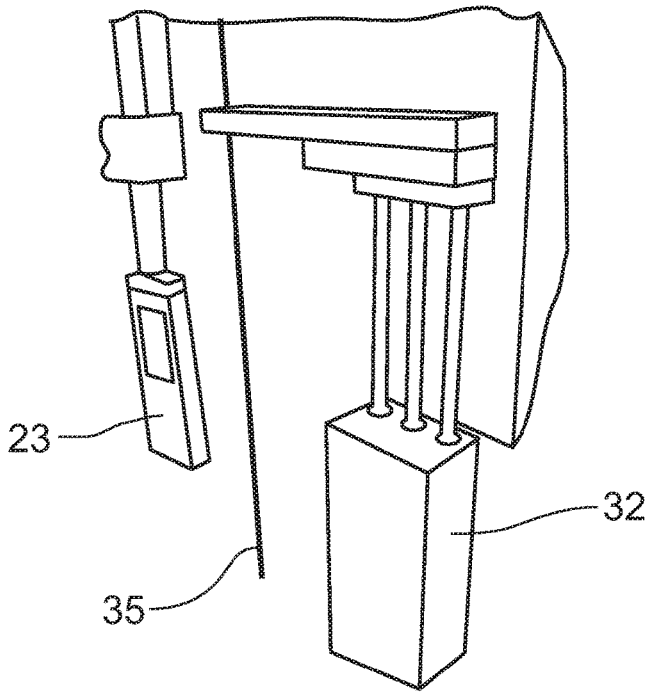
Fig. 7

Fig. 8
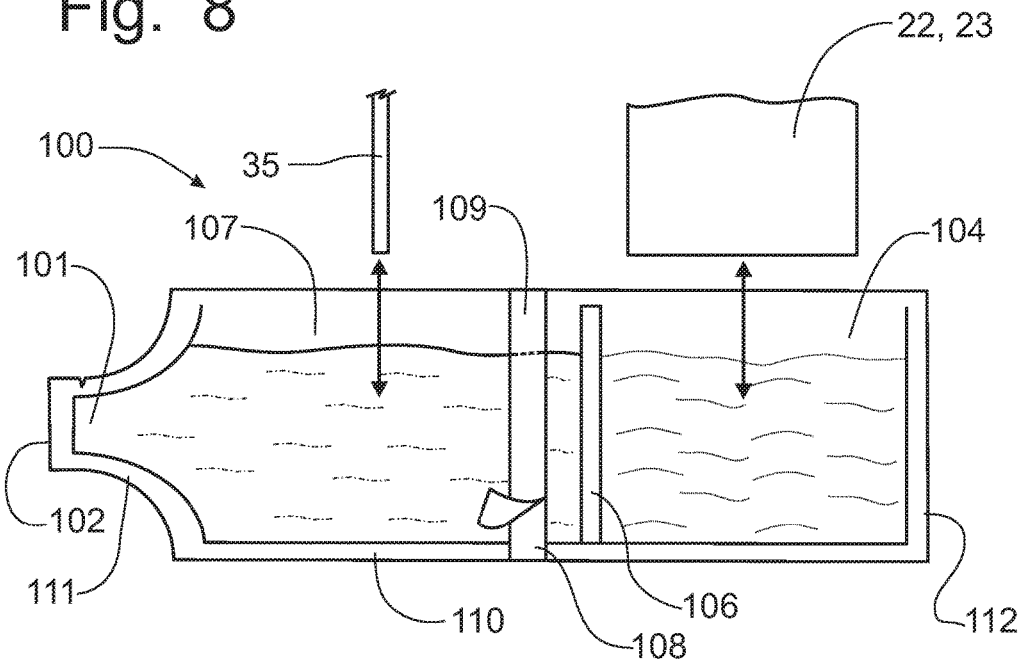
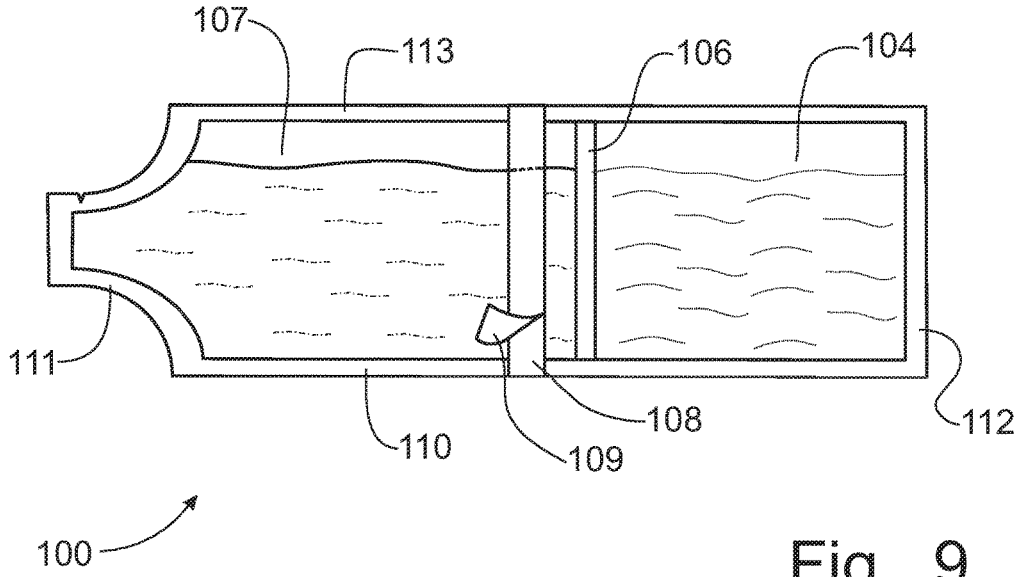
Fig. 9

MACHINE FOR CREATING AND FILLING A MULTI-COMPARTMENT POUCH SIMULTANEOUSLY WITH POWDER AND LIQUID

CROSS-REFERENCE TO RELATED APPLICATIONS

This application claims domestic priority on U.S. Provisional Patent Application Ser. No. 62/124,431, filed Dec. 18, 2014, the content of which is incorporated herein by reference.

FIELD OF THE INVENTION

The present invention generally relates to product packaging and, more particularly, to a machine that will create a mixing pouch having compartments that contain, respectively, liquid and powdered ingredients.

BACKGROUND OF THE INVENTION

In the pharmaceutical, food and cosmetic industries, liquid-based products often come in packaging as a complete, constituted product ready for use. Such product packaging is usually single-use and disposable, rather than being refillable or reusable. Packages often contain a quantity of the product which exceeds that required for a single usage, resulting in the remainder of the product drying out, spoiling, or otherwise going to waste.

These products are commonly sold pre-constituted, i.e. hydrated, ready for immediate use by the end user. However, these products often require stabilizers and chemical preservatives to prevent spoilage. Otherwise, the products would have short shelf lives. These additives detract from how natural the product is. Consumers desire a more natural product, so additives should be avoided when possible. Accordingly, it would be desirable to provide packaging that does not require the use of such chemical additives.

Many products, particularly products in the cosmetic and hair care industries, can be very expensive for the end user. Consumers desire a more affordable product they can use themselves, rather than go to a professional for that product. Providing a packaging that can separate powdered and hydrating components in different compartments of the same package would be a desirable manner in which to present the product to the end users.

Machines that are capable of creating a package that will have liquid and dry components stored in separate compartments of the same packaging, particularly a machine that is operable to simultaneously place the liquid and powder components into the packaging as the packaging is being formed, would be desirable.

SUMMARY OF THE INVENTION

It is an object of this invention to overcome the disadvantages of the prior art by providing a machine that is operable to form a multi-compartment package filled respectively with liquid and powdered components of a product.

It is another object of this invention to provide a machine that will form a mixing pouch that can be filled with a liquid in one compartment and a powder in a second compartment to be subsequently mixed to create a product to be dispensed from the mixing pouch.

It is still another object of this invention to provide a machine that will create a mixing pouch in which the two compartments holding a liquid and a powder respectively are separated by a breakable seal.

It is a feature of this invention that the ingredient in one compartment of the packaging can be forced against the breakable seal to create sufficient force on the seal to rupture the seal and permit the ingredients of the two compartments to be mixed and create a desired product.

It is still another object of this invention to provide a method of creating a mixing pouch having compartments holding a liquid and a powder, respectively, with a breakable seal separating the two compartments.

It is another feature of this invention that the rupture of the breakable seal creates a common interior cavity substantially equal to the combined size of the respective compartments.

It is still another feature of this invention that the machine for creating a multi-compartment package will incorporate an apparatus that can be manipulated to reduce the size of the common interior cavity.

It is still another feature of this invention that the apparatus for reducing the size of the common interior cavity can be formed as an adhesive strip placed by the machine on an exterior surface of the mixing pouch that will hold a rolled up distal portion of the mixing pouch to create a reduced size common interior cavity.

It is an advantage of this invention that the adhesive strip can be covered with a release member that protects the adhesive strip until the mixing pouch is ready to be used to dispense the mixed product from the dispensing end of the mixing pouch.

It is yet another object of the present invention to provide a machine that forms a product packaging which serves both as packaging for a product and as a body for holding, dispensing, and applying the product.

It is still another object of the present invention to provide a machine that will create a single-use or reusable product packaging for, especially those which benefit from, binary or ingredient-segregated packaging.

It is another advantage of the present invention that the machine will create a compact packaging for certain products.

It is still another advantage of the present invention that the problems of product waste is alleviated and that consumer convenience is improved by providing single-use sized partitions of a product.

It is a further object of the present invention to provide a multiple-use product.

It is still another object of the present invention to provide a machine that will create product packaging that does not require additives such as chemical preservatives to maintain freshness in the component ingredients.

It is yet another advantage of this invention to provide a machine to create packaging for a product in which the packaging is inexpensive to produce and, therefore, inexpensive for the end user.

It is a further advantage of the present invention to provide a machine that forms packaging for "Do It Yourself (DIY)" products.

It is still a further object of this invention to provide a method of manufacturing a mixing pouch that is formed with at least two compartments within which at least one compartment contains a liquid and at least one compartment contains a powder, where the compartments are separated by a breakable seal that can be selectively ruptured by applying pressure on the liquid, to permit a mixing of the liquid and powder ingredients to create a product for dispensing from the mixing pouch.

It is yet a further object of this invention to provide a machine that creates a mixing pouch defining a first compartment containing a liquid ingredient and a second compartment containing a powdered ingredient with a selectively breakable seal between the compartments which is durable in construction, inexpensive of manufacture, carefree of maintenance, facile in assemblage, and simple and effective in use.

It is still another object of this invention to provide an apparatus and a method of manufacturing a mixing pouch having a first compartment containing a liquid ingredient and a second compartment containing a powdered ingredient with a selectively breakable seal between the compartments which can be broken to create a common interior cavity that permits the two ingredients to be mixed to create a mixed product for dispensing from the mixing pouch.

These and other objects, features and advantages are accomplished according to the instant invention by providing a packaging machine forms, fills and seals a mixing pouch that includes a first compartment containing a liquid ingredient and a second compartment containing a light powdered ingredient with a breakable seal, preferably formed by an adhesive heat seal, between the two compartments to separate the two ingredients. The machine creates a breakable seal that can be ruptured to form a common interior cavity and allow the mixing of the two ingredients to create a mixed product. One end of the mixing pouch can be formed with a dispenser through which the mixed product is discharged for use. The mixing pouch is a flexible plastic member formed from two opposing plastic sheets, sealed through heat dies and supplied with powdered and liquid components before being completed. The operation of the machine is automated and powered through pneumatic cylinders. Alternatively, the compartments could be filled with different liquid components.

BRIEF DESCRIPTION OF THE DRAWINGS

The advantages of this invention will be apparent upon consideration of the following detailed disclosure of the invention, especially when taken in conjunction with the accompanying drawings wherein:

FIG. 4 is a side elevational detail view of the powder and liquid fill mechanisms, movement of the mechanisms being shown in phantom;

FIG. 5 is an enlarged side elevational detail view of the heated die;

FIG. 6 is an enlarged partial right front perspective view showing the powder supply tray and a supply apparatus for feeding the powder supply tray;

FIG. 7 is an enlarged partial perspective view of the powder and liquid fill mechanisms;

FIG. 8 is an elevational view of the multi-compartment pouch as formed in the first part of the process where the top seal of the pouch has not yet been formed to leave open an access to fill the respective compartments with powder and liquid components, the movement of the powder and liquid fill mechanisms being depicted by arrows; and FIG. 9 is an elevational view of the finish product, the sealed multi-compartment pouch containing separate supplies of powder and liquid ingredients to create a mixed product by rupturing the interior seal.

DETAILED DESCRIPTION OF THE PREFERRED EMBODIMENTS

Figure 1:
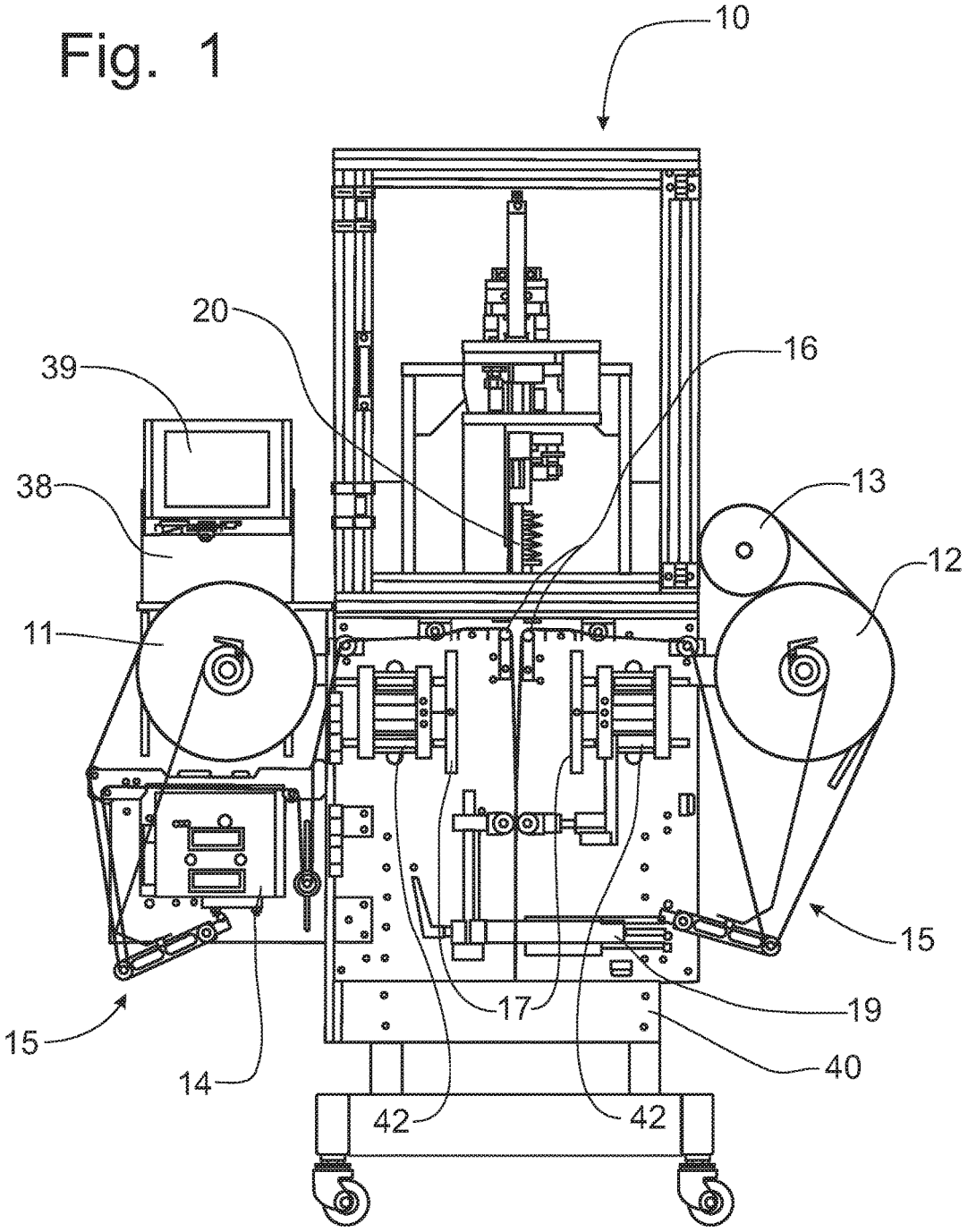
FIG. 1 is a front elevational view of the machine for forming and filling a multi-compartment pouch package simultaneously with powder and liquid, incorporating the principles of the instant invention, the front structure of the machine being removed to provide a better view of the path of movement of the plastic material through the machine.

Referring to the drawings, a machine incorporating the principles of the instant invention can best be seen. The machine 10 is operable to form a multi-compartment package or pouch 100, such as depicted in FIG. 9, where the interior seal 106 separating the two compartments 104, 107 is selectively breakable to permit the mixing of the two components within the respective compartments 104, 107 to create a useable mixed product that can be dispensed from the shaped dispenser end 101 of the pouch 100 once the tip 102 of the dispenser 101 has been separated to allow the mixed product to be dispensed therefrom.

The machine 10 that creates the package 100 having at least two compartments 104, 107 in which are placed a separate ingredient component of the mixed product is shown in FIGS. 1-7. The machine 10 is preferably a somewhat sealed structure to prevent contamination of the preparation of the packaging 100 and the installation of the ingredients therein. Accordingly, the container is preferably formed with transparent sides to permit visualization of the process, but the loading of the powdered component is accomplished through a rotary powder supply tray 25, which is not sealed to allow access to the supply tray 25, which will be described in greater detail below.

On the exterior of the machine 10 on opposing sides thereof, the machine has loaded thereon two opposing rolls 11, 12 of plastic material that are fed into the interior of the machine 10 to form the packaging 100. In the configuration shown in the drawings, the packaging 100 is also provided with an adhesive tape 108 having a release member 109 placed on the exterior surface of the packaging 100. To accomplish that configuration, the machine 10 is also provided with a third roll of tape 13 mounted above the first roll 11 of plastic material such that the tape is fed along the outside of the plastic material from the first roll 11 and secured thereto by adhesive carried by the tape. One skilled in the art will recognize that the rolls 11, 12 of plastic material are a coated plastic that facilitates the sealing through a heated die 17, as will be described in greater detail below. Printing of product information on the front side of the pouch 100 can be provided with an optional printer 14 positioned along the path of movement of the first roll 11 of plastic material before reaching the heated dies 17.

Figure 2:
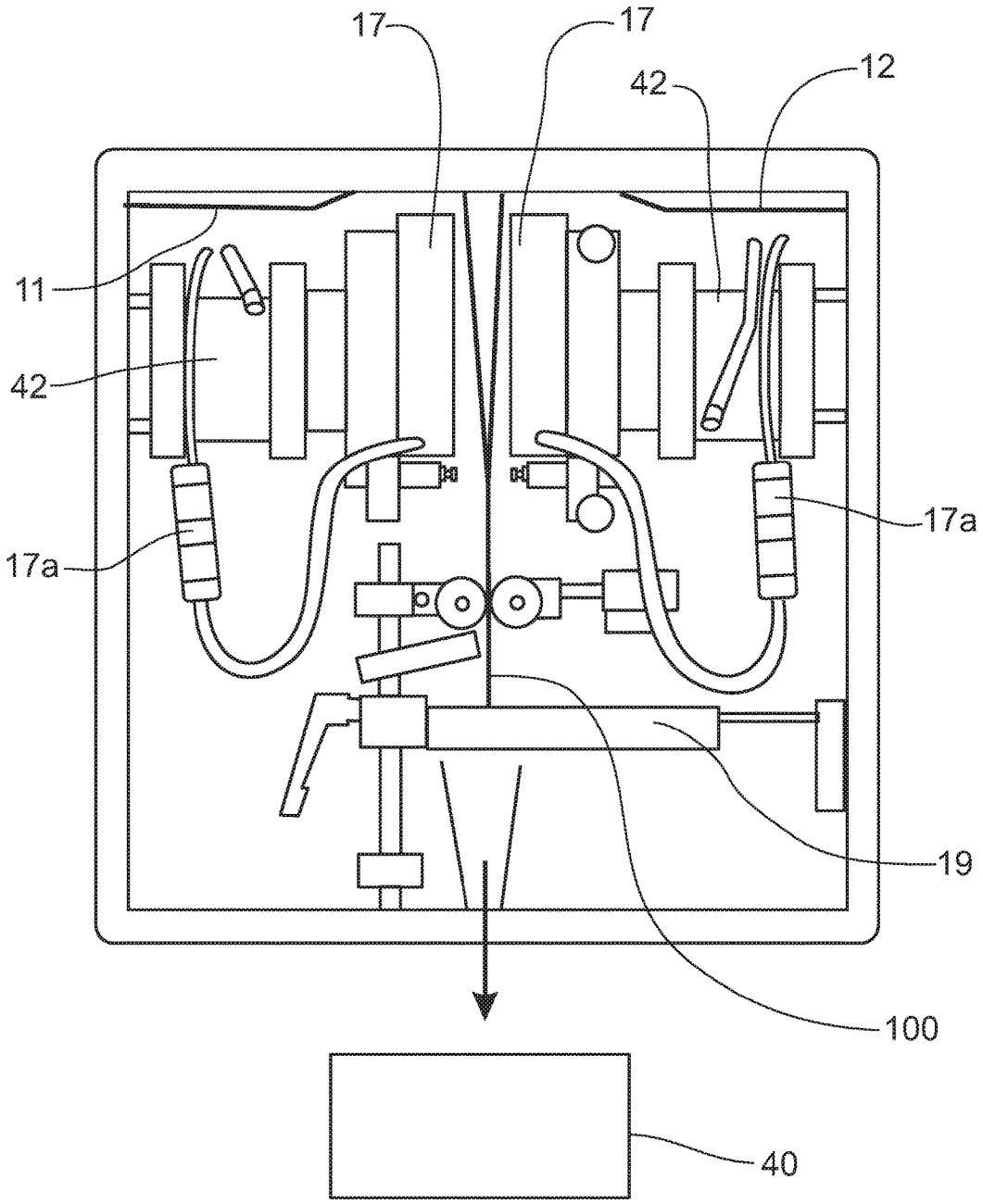
FIG. 2 is an enlarged front elevational view of the lower half of the machine shown in FIG. 1, showing the heated dies and the path of the specially coated plastic material being formed into the multi-compartment pouch.
Figure 3:
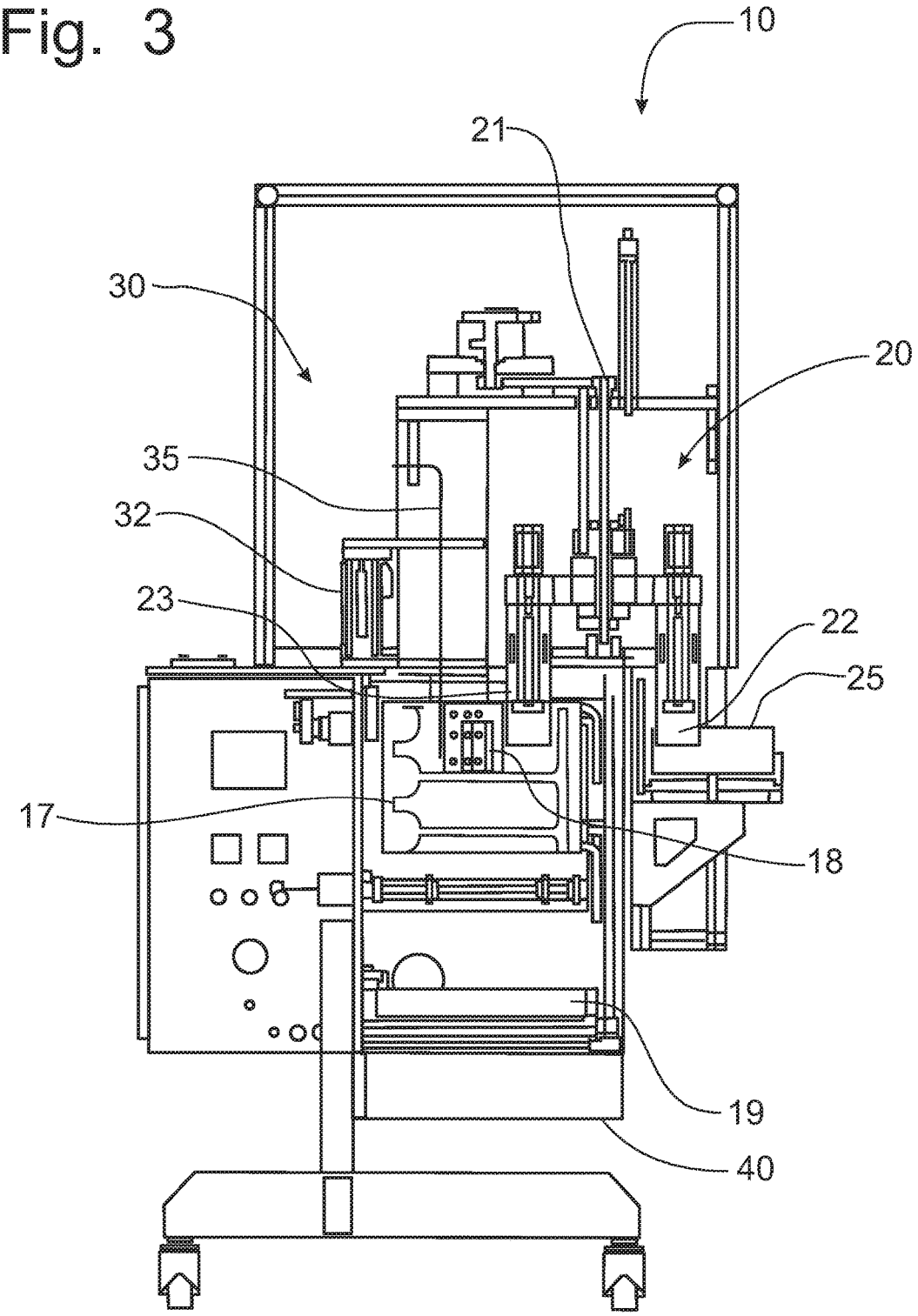
FIG. 3 is a right side elevational view of the machine shown in FIG. 1, but with the roll of plastic material and the side structure of the machine removed to provide more clarity in the relationship between the powder and liquid fill mechanisms and the heated die, the powder fill and liquid fill mechanism being depicted in their lowered position in engagement with the respective pouch compartments.

As is demonstrated in FIGS. 1 and 2, the specially coated plastic materials from rolls 11 and 12, with one having affixed thereon an optional tape material from roll 13, are fed from opposing sides of the machine 10 through a feed web 15 that maintains tension in the plastic materials and supplies the material along a feed path that rises to the mid-portion of the machine 10 and approaches a heated die 17 from converging angles of approach. The two opposing supplies of specially coated plastic material are engaged by the heated die 17 which forms seals around the bottom 110 and sides 111, 112 of the periphery of the pouch 100, and also the interior seal 106. Preferably, the opposing sides of the heated die 17 are movable horizontally through operation of pneumatic cylinders 42 and are heated electrically through the electrical coupling 17*a*. As an example, the interior seal 106 is preferably formed at a different temperature (245° F.) than the temperature (275° F.) on the heated die 17 forming the exterior seals 110-113. The differential in temperatures allows the interior seal 106 to be broken with less force than the exterior seals 110-113 so that the placement of pressure on the liquid component will rupture the interior seal 106 before breaking the exterior seals 110-113 and allow the components in the two compartments to be mixed.

The relative size of the two compartments can be varied as desired by placement of the interior seal 106 at a desired location between the opposing ends 111, 112 of the packaging 100, which can be accomplished by having a heated die 17 in which the central member 18 forming the interior seal 106 is movably positionable within the heated die 17 or providing alternative heated dies 17 that can be substituted depending on the configuration of the packaging 100 that is desired. The outer layer of the pouch 100 must withstand sealing temperature without unacceptable damage. The inside of the material must be coated with an adhesion promoting surface that is activated by the application of heat from the die 17 and allows for a pouch 100 with the desired properties to result.

After the seals 106, 110, 111 and 112 are formed by engaging the opposing spans of specially coated plastic material with the heated die 17, one skilled in the art will recognize that the top portion of the pouch 100 remains unsealed and with the upwardly diverging spans of plastic material forming an opening into which the respective components to be placed into the compartments 104, 107. These two compartments 104, 107 are filled at the same time in spite of the differences of volume, density, and/or weight of the respective product components.

The two compartments 104, 107 are filled simultaneously by separate mechanisms 20, 30. In a configuration requiring a powdered component in the first compartment 104 and a liquid component in the second compartment 107, the powdered component can be inserted with the powder fill mechanism 20. The powder fill mechanism 20 includes a rotatable carriage 21 that has two fill members 22, 23 mounted thereon. When one fill member 22 is over the powder supply tray 25, the other fill member 23 is over the opening into the first compartment 104 of the pouch 100 being formed. The carriage 21 is vertically movable through a defined range of travel through the operation of a pneumatic cylinder (not shown). When the pneumatic cylinder retracts, the two fill members 22, 23 move downwardly such that the first fill member 22 dips into the powder supply tray 25 and the second fill member 23 dips into the opening of the first compartment 104 of the pouch 100 being formed.

When the first fill member 22 is in the powder supply tray 25, a vacuum (not shown) is activated to draw the powdered component into the interior of the fill member 22. The fill members 22, 23 are configured to be calibrated to accept a prescribed volume of material that can be drawn into the interior of the fill member 22, 23. Simultaneously, the second fill member 23 is discharging the prescribed volume of powdered material into the first compartment 104. Preferably, the fill members 22, 23 are provided with a piston having a small blower which turns on as the vacuum applied to the second fill member 23 deactivates, so that the powder within the second fill member 23 is free to be pushed down into the first compartment 104. Two small tubes 27 vacuum any airborne particles of the powdered component that result from the delivery of the powdered component into the first compartment. These two vacuum tubes 27 keep the particles of powder material from polluting the plastic material where the last seal of the pouch is to be formed, as is described in greater detail below.

After the first fill member 22 has been loaded with the prescribed volume of powdered component and the second fill member 23 has discharged the prescribed volume of powdered material into the first compartment 104, the carriage 21 is raised to permit the rotation of the carriage 21 to position the second fill member 23 over the powder supply tray 25, which continues to rotate and has a mechanism 26 that constantly breaks up the powder as the powder supply tray 25 rotates to facilitate movement into the fill members 22, 23. As the fill members turn, the fill member 22, 23 that has the prescribed volume of powdered material within to be delivered from the powder supply tray 25 to the first compartment 104 passes over a knife blade (not shown) that operates to level the exact amount of the prescribed volume of powdered material, and then stops over the open first compartment 104 to be filled. The exterior surfaces of the fill members 22, 23 is covered with an electrostatic coating that allows the fill members 22, 23 to remain clean while operating from picking up of the powder to the delivery of the powder into the first compartment 104.

Simultaneously with the dispensing of the powdered material into the open first compartment 104 of the pouch 100 being formed, the second compartment 107 is being filled with a prescribed volume of a liquid component through the liquid fill mechanism 30 that includes a calibrated peristaltic pump 32 and an articulated plunger 35 that moves into the second compartment 107 at the same time the appropriate fill member 22, 23 is moving into the first compartment 104 to deliver the prescribed volume of powdered material. As the plunger 35 raises to exit the second compartment 107 in conjunction with the carriage 21 raising the two fill members 22, 23, the calibrated peristaltic pump 32 draws in the prescribed amount of liquid to be inserted into the next second compartment 107 to be formed.

After the prescribed volumes of powder and liquid are delivered to the respective first and second compartments 104, 107, the feed web 15 advances the partially formed pouch 100, as well as the two spans of plastic material, to locate the top of the pouch 100 having the filled compartments 104, 107 and the adjacent portions of the opposing spans of specially coated plastic material into engagement with the heated die 17. Preferably, the heated die 17 heat seals the top boundary 113 of the pouch 100 having the prescribed volumes of powder and liquid within the respective first and second compartments 104, 107 at the same time as forming the lower and side boundaries of the next pouch 100 to be formed, as well as the interior seal 106. After the formed and filled pouch 100 exits the heat die 17, an adjustably positionable blade 19 engages the formed and filled pouch 100 and separates the formed and filled pouch 100 from the pouch immediately adjacent. One skilled in the art will recognize the need for a web tensioner to prevent the plastic material web from creeping down as the powder and liquid component materials are loaded into the pouch 100 being formed. Preferably, a vacuum bar web tensioner 16 is utilized at the top of the vertical spans of plastic material.

In operation, a computer system 38 automatically operates the various controls necessary for the operation of the machine 10 to create the formed and filled pouches 100. The supply of powdered material within the rotatable powder supply tray 25 can be replenished manually or sensors (not shown) can be provided to establish when the powder supply tray 25 requires more powder material to be added to the tray 25 from a mechanical device 29, schematically depicted in FIG. 6, that would be within the skill of the art. All controls are preferably pneumatic devices, particularly the cylinders (not shown) that move the powder and liquid fill mechanisms 20, 30.

The powder fill mechanism 20 is preferably reciprocal in rotation back and forth to place first one fill member 22, 23 and then the other fill member 22, 23 in alternating engagement between the powder supply tray 25 to load the prescribed volume of powdered material and then to discharge the prescribed volume of powdered material into the first compartment 104 of the pouch 100 being formed. Simultaneously with the depositing of powdered material into the first compartment 104, the plunger 35 of the liquid fill mechanism 30 deposits the prescribed volume of liquid into the second compartment 107. The plastic material from the two rolls 11, 12 is then advanced, moving the filled and partially formed pouch 100 into position for engagement with the heated die 17 which finishes the sealing of the top boundary 113 of the now formed and filled pouch 100 while forming the seals for the bottom boundary 110, side boundaries 111 and 112, and interior seal 106 for the next pouch 100 being partially formed for subsequent filling with prescribed volumes of both powder and liquid.

The severing of each formed and filled pouch 100 by the blade 19 drops the completed pouch 100 into a hopper 40 for accumulation until a sufficient supply of completed pouches has been received to further package the completed pouches 100. Alternatively, the severed pouch 100 could be received by a conveyor that transports the completed pouch 100 to a remote station for further packaging or processing.

One skilled in the art will recognize that the placement of a liquid ingredient in a first compartment and a dry powdered ingredient in a second compartment of a single common interior cavity of a mixing pouch is a difficult task that is not known in the prior art. Both the liquid and powdered ingredients must remain uncontaminated by the other, and in some scenarios also remain sterile, to maintain the integrity of the ultimate mixing process. Accordingly, the provision of a single mixing pouch having at least two individual compartments separated by a breakable seal divisor to allow a subsequent mixing of the respective ingredients is heretofore unknown in the art. The concept of a two or more compartment mixing pouch having separated liquid and powdered ingredients that can be mixed subsequently to the formation of the mixing pouch.

Furthermore, one skilled in the art will recognize that sensors monitoring the operation of the pneumatic system, the position and orientation of the heated dies 17, the operation of the printer 14, the supplies of powder and liquid into the powder and liquid fill mechanism 20, 30, the temperatures of the heated die 17, tracking of the web feed mechanism 15, the operation of the knife blade 19 separating the formed pouches 100, etc., are required to maintain proper operation of the machine 10. Such sensors (not shown) are within the skill in the art and need not be described in detail. The operation of the machine 10 by the computer 38 requires a monitor 39 to provide feedback on the status of operation of the machine 10. Associated with the computer 38 and the sensors (not shown) are alarm systems (not shown) to provide a warning, preferably both visually and audibly, when a malfunction is detected.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiments of the invention; however, concepts, as based upon the description, may be employed in other embodiments without departing from the scope of the invention. Other systems, methods, and/or products according to the above embodiment will be or will become apparent to one of ordinary skill in the art upon review of the above description, the following drawings, and any further description. It is intended that all such addition systems, methods, and/or products be included within this description, be within the scope of the present invention, and be protected by the accompanying claims.

For example, the pouch 100 being formed could be formed with more than two compartments for filling with different components. To accomplish a three compartment pouch, for example, the heated die 17 would have to be formed in the shape of the three compartments, in the ratios desired to contain the respective components or ingredients. The heated die 17 would have two intermediate members for the creation of two interior seals separating the three compartments. By reducing the temperature of both intermediate members, the interior seals would be breakable before the exterior boundary seals would break, enabling the mixing of the three components, particularly if a liquid component were placed into the central compartment. In addition, the machine 10 would require either a second powder fill mechanism 20 or a second liquid fill mechanism 30. In the event of a second powder fill mechanism 20, the second carriage could be located across from the first carriage 21 with the plunger 35 of the liquid fill mechanism 30 between the two powder fill mechanisms 20.

As another example, the first and second ingredients for placement, respectively, in the first and second compartments 104, 107 could both be liquid components. In such a case, the powder fill mechanism 20 would either be idled, or replaced with the addition of a second fill mechanism 30. Likewise, in the three compartment configuration noted above, the three ingredients could be one powder component with two separate liquid components in the respective three compartments, or even three liquid components. Appropriate substitution of liquid fill mechanisms 30 for the idled or replaced powder fill mechanisms 20 would be required within the machine 10, as would be recognized by one of ordinary skill in the art.

Having thus described the invention, what is claimed is:

1. A machine for forming and filling a pouch having different component materials, including at least one dry component material and at least one liquid component material in at least two compartments separated by a breakable seal, comprising:

a pair of opposing supplies of material having characteristics allowing the supplies of material to seal together upon an application of heat;

a feed mechanism engaged with said supplies of material to present opposing spans of said material in a converging angular orientation;

a heated die positioned at the convergence of said opposing spans of material and selectively engaging said opposing spans of material and forming seals that define a pouch having at least two compartments, said seals including a lower and side exterior perimeter boundary seals and at least one interior seal located between respective said compartments;

at least one dry component fill mechanism and at least one liquid component fill mechanism and being selectively operable to insert simultaneously said dry and liquid component materials respectively into said compartments, said dry component fill mechanism including a rotatable carriage on which is mounted a pair of powder fill members movable in a reciprocal manner, said feed mechanism advancing said pouch and said opposing spans of material such that an upper portion of said pouch is engaged by said heated die to form upper boundary seals to close said compartments after the insertion of said dry and liquid component materials into respective said compartments; and a severance mechanism to sever said pouch from said spans of opposing material after said upper boundary seals have been formed.

2. The machine of claim 1 wherein said heated die engages said opposing spans of material a first time to form seals along a bottom and opposing sides of the pouch being formed, and said breakable interior seal that defines a division between adjacent compartments, thereby creating a partially formed pouch, said heated die engaging said partially formed pouch a second time after said compartments have been filled by said components to form a seal along a top side of said pouch.

3. The machine of claim 2 wherein said liquid component fill mechanism includes a vertically movable filler tube movable into a fill position that is positioned within the corresponding compartment of the partially formed pouch to fill said corresponding compartment before said heated die engages the partially formed pouch to add the top seal.

4. The machine of claim 3 wherein said powder fill members move between a dispense position and a supply position, said rotatable carriage being operable to raise and lower said powder fill members simultaneously between an operable position and a transport position.

5. The machine of claim 4 wherein the placement of said powder fill members into said operable position locates one of said powder fill members in a rotatable supply tray to upload a predetermined volume of said powdered material and locates the other of said powder fill members in the corresponding compartment of the partially formed pouch to discharge a previously uploaded predetermined volume of said powdered material.

6. The machine of claim 5 wherein the placement of said powder fill members in said transport position allows said powder fill members to switch places over said rotatable supply tray and said partially formed pouch, respectively.

7. The machine of claim 2 wherein said breakable interior seal is formed by a positionably adjustable central die member supported on said die, the selective positioning of said central die member being operable to change the location of the breakable interior seal and the ratio of the relative sizes of the compartments.

8. The machine of claim 7 wherein said central die member is heated to a lower temperature than the rest of said heated die member to form a breakable interior seal that will break before the exterior seals along the top, bottom and sides will break.

9. A machine for forming and filling a pouch having different component materials in two compartments separated by a breakable seal, comprising:

a pair of opposing supplies of coated plastic material having characteristics allowing the plastic materials to seal together upon an application of heat;

a feed mechanism engaged with said opposing supplies of plastic material to present opposing spans of said material in a converging angular orientation;

a heated die positioned at the convergence of said opposing spans of plastic material and selectively engaging said opposing spans of plastic material a first time to form seals along a bottom and opposing sides of the pouch being formed, and said breakable interior seal that defines the division between the two adjacent compartments, thereby creating a partially formed pouch having two vertically oriented compartments with an open top side, said heated die engaging said partially formed pouch a second time after said compartments have been filled with said components to form a seal along said top side of said pouch;

a liquid component fill mechanism selectively operable to insert a liquid component into first of said compartments through the corresponding open top side, and a powder component fill mechanism operable to place a powder component into a second of said components while said liquid component is being placed into said first compartment so that said different component materials are placed respectively simultaneously into both said compartments, said powder fill mechanism including:

a rotatable carriage; and a pair of powder fill members mounted on said rotatable carriage and being movable in a reciprocal manner between a dispense position and a supply position, said rotatable carriage being operable to raise and lower said powder fill members simultaneously between an operable position and a transport position; and a severance mechanism to sever each said formed pouch from said spans of opposing material after said upper boundary seals have been formed.

10. The machine of claim 9 wherein said liquid component fill mechanism includes a vertically movable filler tube movable into a fill position that is positioned within the corresponding compartment of the partially formed pouch to fill said corresponding compartment before said heated die engages the partially formed pouch to add the top seal.

11. The machine of claim 10 wherein the placement of said powder fill members into said operable position locates one of said powder fill members in a rotatable supply tray to upload a predetermined volume of said powdered material and locates the other of said powder fill members in the corresponding compartment of the partially formed pouch to discharge a previously uploaded predetermined volume of said powdered material, the placement of said powder fill members in said transport position allowing said powder fill members to switch places over said rotatable supply tray and said partially formed pouch, respectively.

12. The machine of claim 11 wherein said breakable interior seal is formed by a positionably adjustable central die member supported on said die, the selective positioning of said central die member being operable to change the location of the breakable interior seal and the ratio of the relative sizes of the compartments, said central die member being heated to a lower temperature than the rest of said heated die member to form a breakable interior seal that will break before the exterior seals along the top, bottom and sides will break.

13. The machine of claim 12 wherein said a printer is operable along said feed mechanism to print product information on one of said spans of plastic material.

14. A method of forming a package for a mixable product, said package having two compartments separated by a breakable interior seal and including different component materials within said two compartments to be mixed subsequently when the breakable interior seal is ruptured to allow a mixing of the respective component materials, comprising the steps of:

feeding two opposing spans of plastic material through a feed mechanism that presents the opposing spans of plastic material in a converging orientation;

engaging said opposing spans of plastic material at said convergence to form exterior perimeter boundary seals along bottom and opposing sides of said converging plastic material and said interior seal to create a partially formed pouch having two compartments on opposite sides of said interior seal;

simultaneously filling said two compartments with the respective said component materials placed into an open top side of the partially formed pouch, said filling step including a powder fill step and a liquid fill step, said powder fill step including the steps of:

utilizing a pair of opposing, vertically movable powder fill members mounted on a rotatable carriage, said powder fill members being vertically movable between a raised transport position and a lowered operative position, said carriage being rotatable to locate said powder fill members, respectively, over a powder supply tray and over a first compartment of said package;

lowering said powder fill members from said transport position to said operative position to enable one of said powder fill members to engage said powder supply tray to upload a predetermined volume of powdered component while the other powder fill member discharges a previously uploaded predetermined volume of powdered component into said first compartment of said package;

raising said powder fill members to said raised transport position; and rotation said carriage to re-position said powder fill members such that the emptied powder fill member is positioned over said powder supply tray and said loaded powder fill member is positioned over said first compartment;

re-engaging said partially formed pouch to form a seal along said top side to create a completed pouch after said respective said component materials are placed into said compartments; and severing each completed pouch from the spans of plastic material.

15. The method of claim 14 wherein said engaging and re-engaging steps are performed by moving a heated die into engagement with said plastic material, said heated die having a central member heated to a lower temperature than the remainder of said heated die forming said exterior perimeter seals.

16. The method of claim 14 wherein said liquid fill step includes the steps of:

utilizing a liquid fill plunger operatively connected to a supply of liquid to be dispensed into a second compartment of said package separated from said first compartment by said breakable seal and being movable vertically between a raised position and a lowered position;

lowering said liquid fill plunger into said lowered position so that a distal tip of said plunger is positioned within said second compartment, said step of lowering said liquid fill plunger being accomplished simultaneously with said step of lowering said powder fill members;

dispensing a predetermined volume of said liquid into said second compartment; and raising said liquid fill plunger to said raised position.

17. The method of claim 16 wherein said engaging and re-engaging steps are accomplished by moving a heated die into engagement with said opposing spans of plastic material to join said opposing spans of plastic material along said exterior perimeter boundary seals and said interior seal.

* * * * *